US005935474A

United States Patent [19]

Grischenkov et al.

[11] Patent Number: 5,935,474

[45] Date of Patent: Aug. 10, 1999

[54] ELONGATED FLEXIBLE ELECTRICAL HEATER AND A METHOD OF MANUFACTURING IT

[75] Inventors: Gennady Porfirievich Grischenkov; Petr Alexeevich Korenev; Igor Anatolievich Kozlov; Vladimir Arkadievich Vjuchkov; Andrei Borisovich Tkachenko; Leonid Gurievich Shusharin, all of St. Petersburg, Russian Federation

[73] Assignee: R-Amtech International, Inc., Bellevue, Wash.

[21] Appl. No.: 08/952,934

[22] PCT Filed: May 28, 1996

[86] PCT No.: PCT/RU96/00135

§ 371 Date: Jan. 12, 1998

§ 102(e) Date: Jan. 12, 1998

[87] PCT Pub. No.: WO96/39006

PCT Pub. Date: Dec. 5, 1996

[30] Foreign Application Priority Data

May 29, 1995 [RU] Russian Federation ..... 95108156
Jun. 1, 1995 [RU] Russian Federation ..... 95108282

[51] Int. Cl.[6] ..... H05B 3/34; H05B 3/10; H01R 4/00

[52] U.S. Cl. ..... 219/549; 219/548; 174/84 C

[58] Field of Search ..... 219/549, 545, 219/541, 548; 439/860, 883, 877, 882; D13/133; 174/169, 84 C; 29/874; 33/24 R

[56] References Cited

U.S. PATENT DOCUMENTS

| | | | |
|---|---|---|---|
| 3,538,482 | 11/1970 | Levin . | |
| 3,774,013 | 11/1973 | Keep | 219/544 |
| 3,972,585 | 8/1976 | Dalgleish | 219/535 |
| 4,029,942 | 6/1977 | Dugger . | |
| 4,357,070 | 11/1982 | Fukushima | 339/278 |
| 4,488,770 | 12/1984 | Lui | 339/263 |
| 4,689,601 | 8/1987 | Coffey | 174/120 |
| 4,795,380 | 1/1989 | Frantz | 439/860 |
| 4,864,107 | 9/1989 | Boyal | 219/549 |
| 4,928,344 | 5/1990 | Biss | 219/544 |

FOREIGN PATENT DOCUMENTS

| | | |
|---|---|---|
| 2193297 | 2/1974 | France . |
| 2386955 | 11/1978 | France . |
| 1237238 | 3/1967 | Germany . |

*Primary Examiner*—Teresa Walberg
*Assistant Examiner*—Daniel Robinson
*Attorney, Agent, or Firm*—Griffin, Butler, Whisenhunt & Szipl, LLP

[57] ABSTRACT

The invention pertains to flexible heating elements with carbon fiber resistive elements and can be used independently for heating greenhouses, domestic and industrial premises and as a component in other devices such as heaters. The invention also concerns a method of manufacturing the flexible heating elements in question. An electrical heater is a resistive element in the form of a bundle of carbon fibers; an insulating first layer made from a heat-conducting material in the form of a winding or braid, and a second layer made from polymer material; current supply elements each of which has three pairs of lobes. One of these pairs secures the end of the resistive element freed from the electrical insulation between the tip and a section of the first insulating layer; the second compresses the second electrically insulating layer; the third secures the insulating tube. The technical result of the invention is an increase in the unit surface heat release, improved reliability of the electrical heater, and simpler and more industrially efficient manufacture.

10 Claims, 2 Drawing Sheets

ELONGATED FLEXIBLE ELECTRICAL HEATER AND A METHOD OF MANUFACTURING IT

FIELD OF THE INVENTION

The elongated flexible heater pertains to heating devices, in particular to flexible heating elements with carbon fiber resistive elements.

The elongated flexible heater can be used independently as a heating element for heating greenhouses, domestic and industrial premises as well as a component in other devices such as heaters.

BACKGROUND OF THE INVENTION

Elongated heaters using metallic alloys as resistive elements are well-known. German patent document DE 29 17 639 describes an elongated electrical heater with an electrically insulating core. A resistive metallic element is wound around the core and to the resistive metallic element an insulating layer is applied.

The major drawback of this heater is the low reliability of the one-layer insulation. While bending and after long-term use, the resistive metallic element may press through the insulation.

European patent document EP 0 368 776 suggests an elongated heater, which contains one or more cores of a resistive element, on the outside coated with two electrically insulating layers. The outer layer is made of an inflexible insulating material preventing the electrical heater from bending. This is a major drawback, since the electrical heater's range of application is limited considerably, because it is not possible to adapt it to different dimensions of the objects to be heated.

Closest prior art, British patent document GB 1303917, which is chosen as the prototype, describes an elongated flexible heater containing a resistive element made of carbon fibers, realized with a cluster of filaments and with two insulating layers. The first layer permeates and secures the filaments of a resistive element and is made of an elastic heat-conducting electrically insulating polymeric material. The second layer is made of an analogous material in the form of a covering layer. Current supply tips are connected to the free ends of the resistive element. On the outside the unit is covered with an insulating tube. The drawback of this electrical heater is the low reliability of its insulation, since, in the process of permeating and securing the resistive element using an elastic insulating material, the coating's thickness may vary very strongly in respect of the bundle's perimeter and length, up to the point that in some parts there may be no insulation at all. In these parts there is only one insulation in the form of a covering layer. If this insulation is damaged, in particular because of the contact with the heated resistive element, the heater may be short-circuited and destroyed. Another drawback of this apparatus is the low reliability of the fastening of the resistive element to the current supply elements directly by the tip, since under pressure a strong contact between the fragile carbon fibers and the metal takes place. If such a contact takes place, a part of the carbon fibers will be destroyed which, under working conditions, will be followed by an increase of the contact resistance and by overheating and destruction of the contact point. If the heater is subjected to mechanical stress (tensile stress) the stress will be transmitted over the tip to the resistive element and there the heater might be destroyed because of weak mechanical contact with the carbon fiber. The problem resulting from the aforementioned is to overcome the above-indicated drawbacks and come to a technical result with a broader working temperature range, with an increased unit surface heat relase and with an improved reliability of the elongated flexible electrical heater and to present a simpler and more effective method of manufacturing it.

SUMMARY OF THE INVENTION

The indicated problems may be solved and the technical result in respect of the elongated flexible electrical heater may be reached, if the elongated flexible electrical heater is made in the form of a bundle of carbon filaments with two electrically insulating layers, one made in the form of a winding or braid made of fibrous material, the second layer made of a polymer coating, the ends of resistive elements are freed from the electrical insulation and secured to tips with three pairs of lobes, a section of the first electrically insulating layer being secured by the first pair of lobes, and a second pair of lobes compressing the second electrically insulating layers and the third pair of lobes securing an insulating tube.

In the elongated flexible electrical heater a resistive element is spirally wound around a solid core (such as element 10 in FIG. 2*b*, 3*a* and 3*b*) made of fibrous material and is made of a bundle of glass fibers with a pyrocarbon coating. A winding step t in FIG. 3*b* of the resistive element is chosen bigger or equal to 5 mm. On the resistive element, discretely in respect of the length T, there are placed coating sections 3' with a low electric resistance, shunting corresponding sections 3" with a high electric resistance, wherein the electrically low resistant sections are chosen with a resistance which is the hundredth or two hundredth part of the resistance of the electrically high resistant sections.

The realization of the resistive element in the form of a bundle improves the reliability avoiding the breaking of carbon filaments when bent in small radii. The reliability of the electrical insulation is improved by braiding or winding, avoiding an uncovering of the sections of the heated resistive element as well as its contact with the second polymer insulating layers even when bent in small radii. The technical result is that the unit surface heat release is increased and the working temperature range of the heater is broadened.

Further the heater's reliability is improved in that the first insulating layer is made of fibers, which guarantee the heater's durability, and by avoiding destruction of carbon fibers when attaching them to the tips by bending and this way fastening the resistive element to the first insulating layer and by compression using the lobes of the tip. While doing this the lobes of the tip are not in direct contact with the resistive element. The compression is exerted through a soft layer (a bundle of the resistive element in a fibrous insulation). This way a reliable electrical contact with a low contact resistance is guaranteed. In order to improve the reliability of the tip's mechanical fastening to-the power insulating layer, the tip is supplied with a second pair of lobes, pressed to the first insulating layer, which is stripped from its outer covering. Further the end element is supplied with a third pair of lobes in order to secure the polymer insulating coating.

In respect of the method a technical result is achieved by that in the method of manufacturing an elongated flexible electrical heater, in which two electrically insulating layers are applied to an intermediate product of a resistive element made of carbon fibers in the form of a cluster of filaments, the ends of a resistive element are freed from an electrical insulation, current supply elements are placed on the ends and a connection unit of the resistive element is closed with a current supply element of an insulating tube, the filaments of the intermediate product of a resistive element are combined in a bundle, at the same time the filaments are wound, in the process of applicating the first electrically insulating layer the tension of the filaments of a resistive element is regulated in order to keep it in bundle form, freeing the end of the resistive element from the electrical insulation a section is removed in the second layer, which section is longer than the length of the removed section of the first layer by approximately the length of the freed end of the resistive element, which is bent and secured between the first electrically insulating layer and the current supply element tip, which is supplied with three pairs of lobes, the pressure of which lobes secures all elements of the electrical heater.

In the process of obtaining the intermediate product of a resistive element the carbon filaments are spirally connected in a bundle and while applicating the first electrically insulating layer by braiding and winding, the heat conducting fibrous material regulates the filaments' tension to keep them in the form of a bundle. This is an automatic process and it does not need to be regulated while operating. Harmful chemical compounds are not released. Further, it is not necessary to add a metallic additive to the polymer mass in order to increase the heat conduction. A second insulating layer is applied by extrusion in an automated process as well. The resistive element is not permeated. When freeing the ends of the resistive element from the electrical insulation, a section is removed in the second layer, which section is longer than the length of the removed section of the first layer by approximately the length of the freed end of the resistive element. Because permeation does not take place it is sufficiently simple to carry out this operation with a high quality and without damaging the resistive element.

The bending of the resistive element and its securing between the first electrically insulating layer and the tip simplifies the compression of the resistive element, since a controlling step is not necessary after the compression process.

A research, carried out in respect to patent and periodical literature, has shown that the totalities of this application are unknown, i.e. that they fulfil the patentability requirement of "novelty".

Since there is a need for such elongated flexible electrical heaters and the method of their manufacturing is realized by known methods, known assemblies, and known materials the invention as applied for fulfils the requirement of "industrial applicability". And since the use of the elongated flexible electrical heater in the course of its operation will lead to a new effect expressing itself in an improved reliability, a broader working temperature range and an increased unit surface heat release, the invention as applied for fulfils the requirement of an "inventional step".

DETAILED DESCRIPTION OF THE INVENTION

Figure 1:
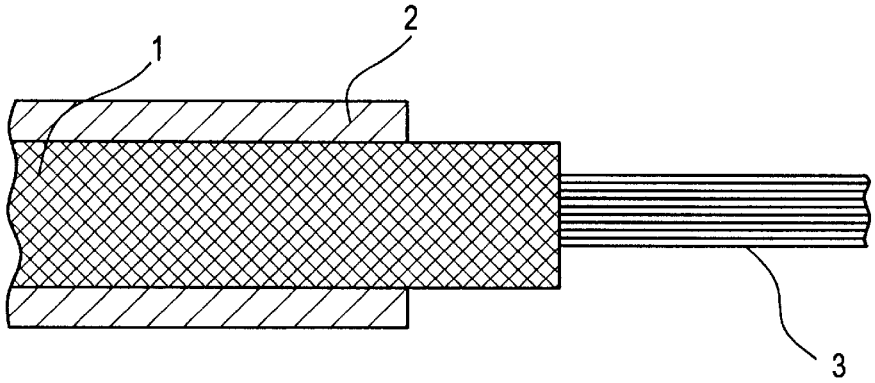
FIG. 1 is a segmented, cutaway view of an operational part of a heater of this invention, where 1 is the first insulating layer made of fibrous material, 2 is the second insulating layer made of polymer material, 3 is the resistive element.
Figure 2A:
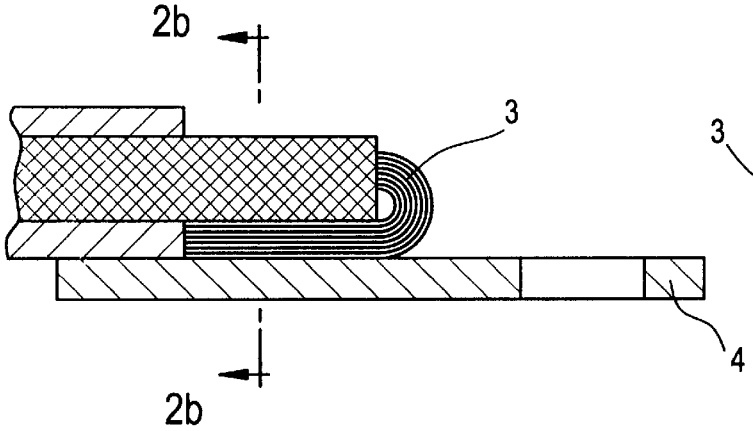
FIG. 2*a* is a view similar to FIG. 1, but further including a tip and illustrating a scheme of a connection between the resistive element and the tip, where 4 is the tip and 5 is a pair of lobes of the tip.
Figure 2B:
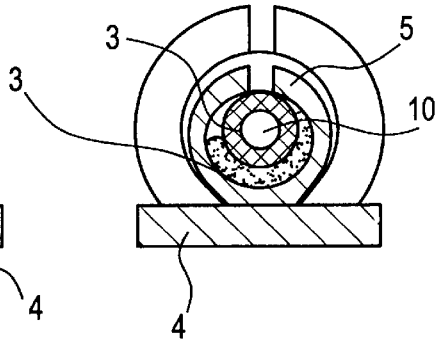
FIG. 2*b* is a sectional view taken on a line 2*b*—2*b* in FIG. 3 of the elements depicted in FIG. 2*a,* but with the tip being bent, with 5 indicating a first pair of lobes of the tip.
Figure 3:
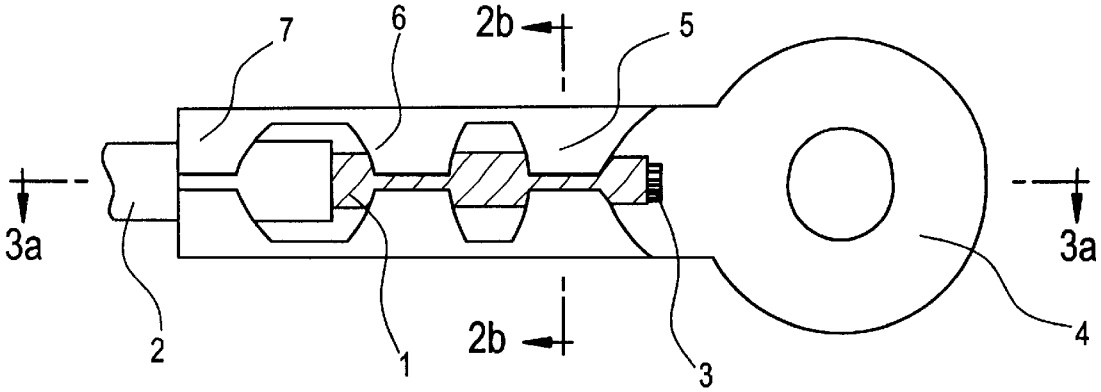
FIG. 3 is a segmented top view of the structure of FIG. 2*b* which is a unit fastening the heater to the tip, where 6 is a second pair of lobes of the tip, 7 is a third pair of lobes of the tip.
Figure 3B:
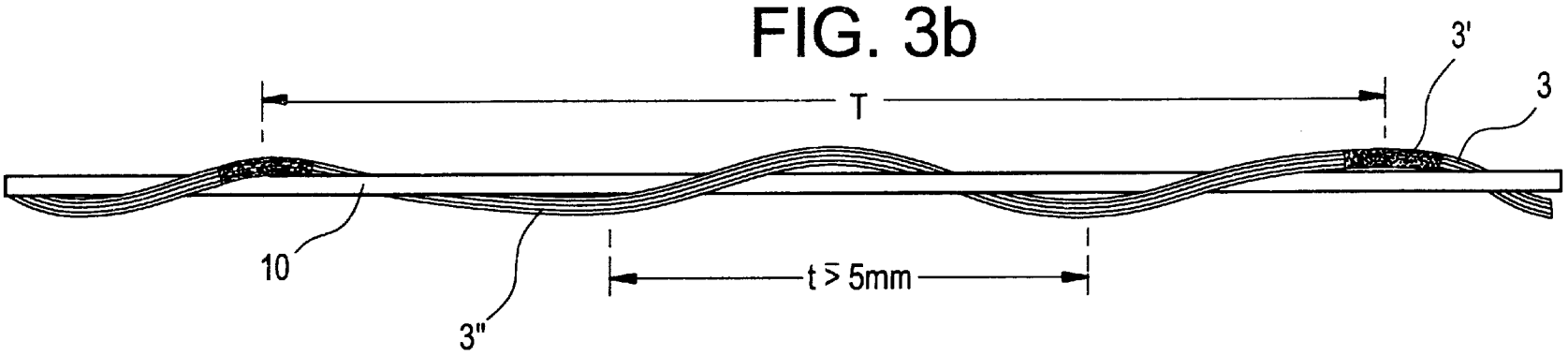
FIG. 3*b* is a side view of an electric heater of this invention with covering layers removed so as to expose a spirally wound resistive element on a solid core.
Figure 3A:
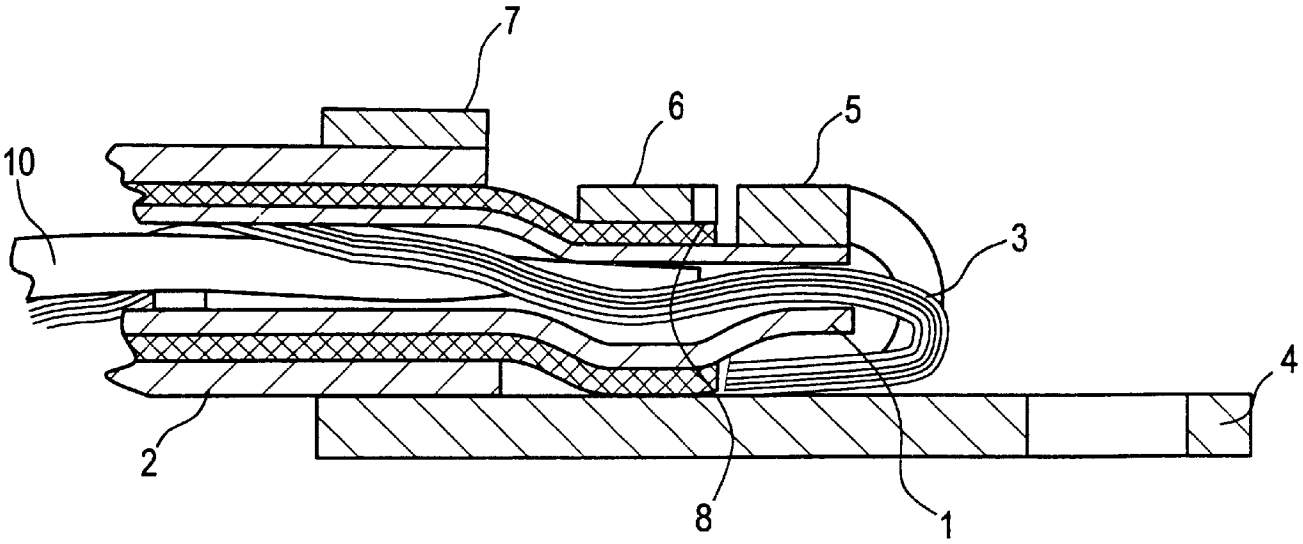
FIG. 3*a* is a sectional view taken on line 3*a*—3*a* in FIG. 3 showing more details.

A method may be realized in the following way: A cluster of carbon filaments 3, wound in the form of a bundle, is braided or wound with filaments 1 made of electrically insulating material and extruded with the application of a polymer insulating covering layer 2. During the process of braiding and winding the tensile stress of the filaments is controlled in order to keep the form of the bundle. This way a steady thickness of the first insulating layer is obtained, which is two times bigger than the thickness of the braiding (winding) filaments. This way one working cycle is enough to obtain a first fibrous and a second polymer insulating layers The obtained half-finished product is cut into pieces of a regular length. At the end of the pieces the first and second insulating layers are removed. The length of the first layer to be removed is approximately the same as the length of the hold of a first pair of lobes 5 of a tip 4. The length of the second layer to be removed is two times the removed length of the first layer. The freed end of the resistive bundle is bent by 180 degrees and placed to the tip in such a way that it is held by the first pair of lobes 5. The compression of the lobes takes place in a stamp, which assures a simultaneous compression by the first lobes 5 of the bent resistive element with the first insulating layer, by second lobes 6 of the first insulating layers and by third lobes of the second insulating layer.

Description of a Varient of the Invention

From 10 carbon fiber filaments 3 of the type "URAL H-22" a bundle with 30 to 40 twists on 1 per meter is obtained on a twisting frame (type TK-160 I). On a weaving machine of the type ŠP-16 the bundle is braided by 16 siliceous filaments with a linear density of 200 tex and is sent through an extruder of the type ENS 45×25. In the extruder a second insulating layer in the form of a covering of the type PVC is applied to the fibrous insulating layer. The thickness of the insulation of the first layer is 0,8 mm, and the thickness of the second layer is 1,0 mm .

The obtained half-finished product is cut into intermediate products with a length of 15 m. At the ends of the intermediate products the insulation is removed. The first fibrous layer 1 at a length of 10 mm, the second one 2 at a length of 20 mm. The freed end of the resistive bundle is bent by 180 degrees and placed to the tip in such a way that it is held by the first pair of lobes 5. The compression of the lobes takes place in a stamp.

The invention claimed is:

1. An elongated flexible electrical heater, containing a resistive element made of carbon fiber in the form of a cluster of filaments, at least two electrically insulating layers outside said filaments for covering said filaments, a first of said layers, closest to said filaments, being made of a heat-conducting material, a current supply element including a tip and at least two pairs of lobes, wherein the resistive element is made in the form of a bundle and the first electrically insulating layer in the form of a winding made of a fibrous material, and wherein a freed end of the resistive element which is freed from the electrical insulating layers, is bent to lie along an outside of a freed section of the first electrical insulating layer, that is likewise freed of insulation outside it, and is secured between the tip and the freed section of the first electrically insulating layer by a first pair of lobes of the current supply element, and wherein a second electrically insulating layer is compressed by another of the at least two pairs of lobes of the current supply element.

2. An elongated flexible electrical heater according to claim 1, wherein the resistive element is spirally wound around a solid core made of fibrous material.

3. An elongated flexible electrical heater according to claim 1, wherein the resistive element is made of a bundle of glass fibers with a pyrocarbon coating.

4. An elongated flexible electrical heater according to claim 1, wherein a winding of the resistive element is chosen to be at least 5 mm.

5. An elongated flexible electrical heater according to claim 1, wherein on the resistive element, discretely in respect of the length, there are placed coating sections with a low electric resistance, shunting corresponding sections with a high electric resistance, wherein the electrically low resistant sections are chosen with an electric resistance which is at least as small as a hundredth part of the resistance of the electrically high resistant sections.

6. An elongated flexible electrical heater according to claim 1 wherein there is a further electrical insulator on the resistive element, wherein said another of the at least two pairs of lobes of the current supply element is a second pair for compressing on the second electrically insulating layer and wherein the current supply element has a third pair of lobes for securing to the further electrical insulator.

7. An elongated flexible electrical heater according to claim 1 wherein said another of the at least two pairs of lobes of the current supply element is a third pair for compressing on the second electrical insulating layer and wherein the current supply element has a second pair of lobes for securing to the first insulating layer.

8. An elogated flexible electrical heater according to claim 1 wherein said pairs of lobes are constructed as one piece with said tip.

9. A method of manufacturing an elongated flexible electrical heater in which at least first and second electrically insulating layers are applied to a resistive element made of carbon fibers in the form of a cluster of filaments, at least one end of the resistive element is freed from said electrical insulating layers, and a current-supply tip is attached to said at least one end, said method including the substeps of: arranging the filaments of the resistive element in a bundle form; applying the first electrically insulating layer to the filaments of the resistive element while regulating a tension of the filaments of the resistive element in order to keep them in the bundle form; freeing the at least one end of the resistive element from the first and second electrical insulation layers by removing a section of the second electrical insulation layer which is longer than a length of a removed section of the first electrical insulation layer; bending the freed at least one end of the resistive element along the first electrically insulating layer and securing it between the first electrically insulating layer and the current-supply tip with a first pair of lobes of the current-supply tip and securing the current-supply tip to the second electrically insulating layer with a further pair of lobes of the current-supply tip.

10. A method as in claim 9, wherein said resistive element is covered by an additional electrical insulator and wherein the current-supply tip is secured to the additional electrical insulator by a third pair of lobes of the current-supply tip, said further pair of lobes being a second pair of lobes for securing the current-supply tip to the second electrically insulating layer.

* * * * *